US006905379B1

(12) United States Patent
Jackson

(10) Patent No.: US 6,905,379 B1
(45) Date of Patent: Jun. 14, 2005

(54) PORTABLE CANOE PROPULSION SYSTEM

(76) Inventor: Reinhard Erwin Jackson, 122, Nicholson's Point, RR#3, Bath (CA) K0H 1G0

( * ) Notice: Subject to any disclaimer, the term of this patent is extended or adjusted under 35 U.S.C. 154(b) by 13 days.

(21) Appl. No.: 10/722,399

(22) Filed: Nov. 28, 2003

(51) Int. Cl.[7] ..... B63H 16/20
(52) U.S. Cl. ..... 440/30
(58) Field of Search ..... 440/21, 26, 29–31; 114/347, 364

(56) References Cited

U.S. PATENT DOCUMENTS 1,246,729 A * 11/1917 Dresher ..... 440/31
2,612,859 A * 10/1952 Billman et al. ..... 440/31
2,940,415 A * 6/1960 Schwarzer ..... 440/29
3,377,976 A * 4/1968 Gustine ..... 440/28
4,427,392 A * 1/1984 Schneider ..... 440/30
4,676,755 A 6/1987 Yagan
4,891,024 A 1/1990 Benjamin
4,943,251 A 7/1990 Lerach
5,217,398 A * 6/1993 Meron et al. ..... 440/26
5,282,762 A 2/1994 Cerreto
6,083,065 A 7/2000 Hall
6,165,030 A 12/2000 Lewis

* cited by examiner

*Primary Examiner*—Andrew D. Wright
(74) *Attorney, Agent, or Firm*—Dowell & Dowell, P.C.

(57) ABSTRACT

A portable pedal driven propulsion device for a small watercraft in which power from crank operated pedals is transmitted to a pivotally mounted gearbox on the outside of the watercraft adjacent the operator. A longitudinal drive shaft is connected, at one end, to the gear box and, at the other end, to a propeller so that the drive shaft and propeller can be moved selectively between a raised inoperative position and a lowered operative position.

12 Claims, 9 Drawing Sheets

PORTABLE CANOE PROPULSION SYSTEM

FIELD OF INVENTION

This invention relates to a portable propulsion device for use in a small watercraft such as a canoe. More particularly, this invention relates a portable pedal and seat device for driving an outboard propeller pivotally mounted alongside the canoe for movement between an operative position wherein the propeller is in the water and an inoperative position wherein the propeller is out of the water and the propeller drive shaft is in a plane parallel the gunwhale of the canoe.

BACKGROUND OF INVENTION

Pedal operated watercraft, such as canoes, are well known in the art and there are numerous patents directed to specific features thereof. Such devices generally comprise a frame structure, with or without a seat, having a pedal crank and sprocket system connected, by way of a chain, to a drive shaft which drives, via a series of gears and pinions, a vertically mounted drive shaft at the stern of the watercraft which in turn drives a propeller mounted on a horizontal axis. Such devices are relatively complex and involve a long gear train which is inherently expensive. The rigidly mounted vertical shaft at the stern to drive the propeller implies that the propeller is at a fixed depth relative to the keel of the watercraft, and it is difficult, if not impossible, for a canoeist to turn around in a relatively unstable canoe to reach the vertically mounted drive shaft at the stern so as to raise the propeller out of the water when not in use or in shallow water. There is a need, therefore, for a simple pedal operated propulsion system in which the propeller can be raised or lowered easily by the canoeist without moving from his seat or even turning to face the rear of the canoe. Preferably, the canoeist should be seated as low as possible in the canoe for stability reasons and the pedal device should incorporate both the seat and the crank mechanism and should be simply placed across the gunwhales of the canoe without needing clamps, bolts or other devices to secure it in place.

OBJECT OF INVENTION

It is an object of the present invention to provide a portable crank-operated, propeller driven, propulsion system for use in a canoe or other small watercraft, in which the propeller is mounted on a propeller shaft which can be raised to, or lowered from, a substantially horizontal position parallel to the gunwhale of the canoe to an operative position in which the propeller shaft is at an acute angle relative to the gunwhale and the propeller is at any selected depth in the water.

BRIEF STATEMENT OF INVENTION

By one aspect of this invention there is provided a portable, pedal driven propulsion device, for use in a watercraft having gunwhales, comprising:

(a) a substantially quadrilateral frame adapted to be releasably mounted on the gunwhales of said watercraft;

(b) operator seat means mounted on said quadrilateral frame;

(c) pedal crank means mounted forwardly of, and depending from, said quadrilateral frame and operable by an operator sitting on said seat means;

(d) a gear box pivotally mounted, on said quadrilateral frame so as to lie outboard of one of said gunwhales and forward of said operator seat means when in operative position;

(e) means to transmit motive power generated by said pedal crank means to said gear box; and (f) longitudinal drive shaft means operatively connected at one end thereof to said gear box and, at a second end thereof, to a propeller means;

said gear box and drive shaft means being adapted to be pivoted, when mounted on said watercraft, about a horizontal transverse axis so as to raise said propeller means to an inoperable position wherein said drive shaft means is substantially parallel to said one gunwhale, and lower said propeller means to an operative position wherein said drive shaft means is at an acute angle relative to said gunwhale.

DETAILED DESCRIPTION OF PREFERRED EMBODIMENTS

Figure 1:
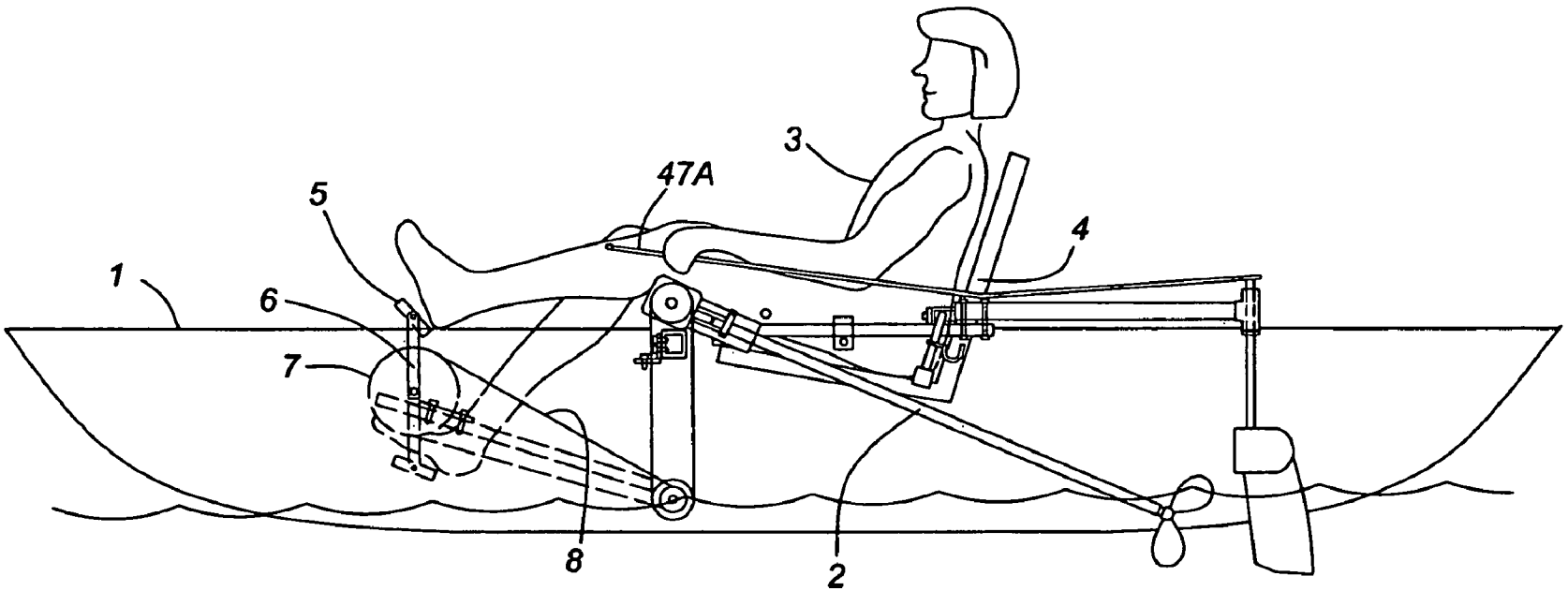
FIG. 1 is an isometric side view of one embodiment of the present invention, mounted on a canoe.
Figure 2:
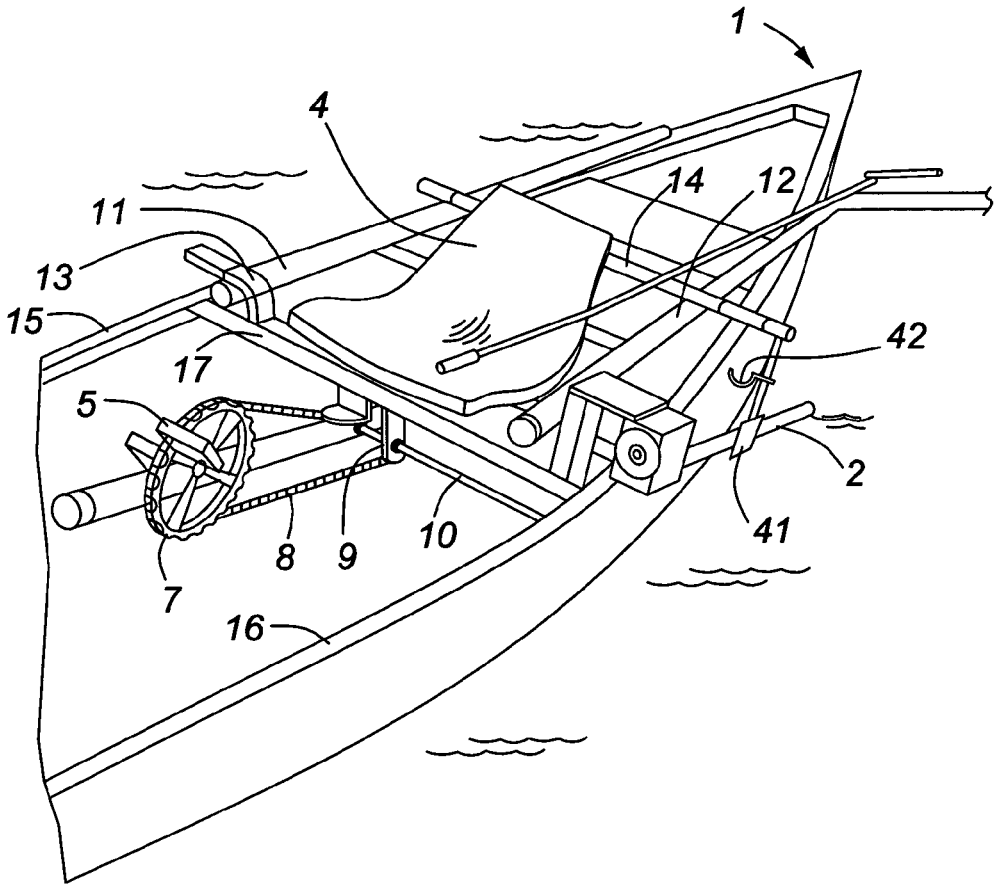
FIG. 2 is an oblique isometric front view of the embodiment of FIG. 1.
Figure 3:
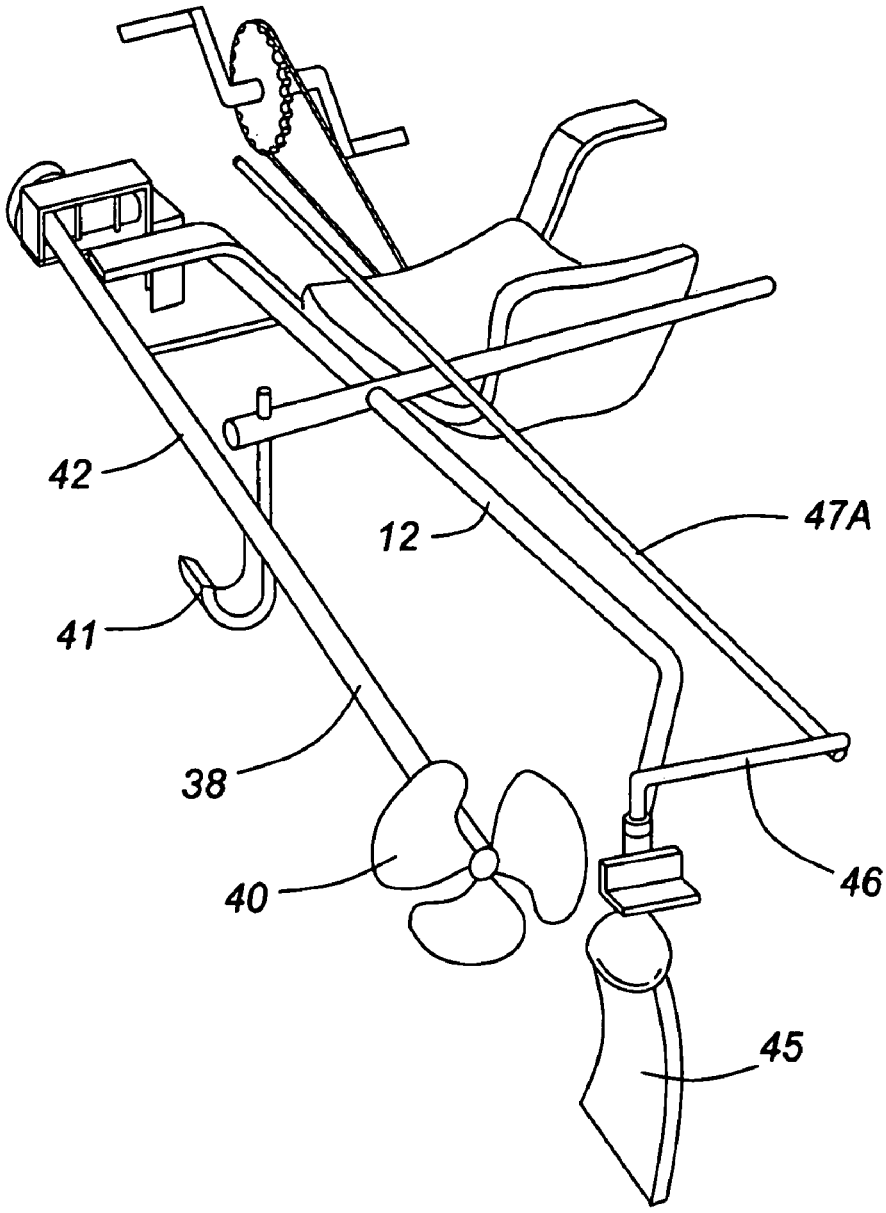
FIG. 3 is an oblique isometric rear view of the embodiment of FIG. 1.
Figure 4:
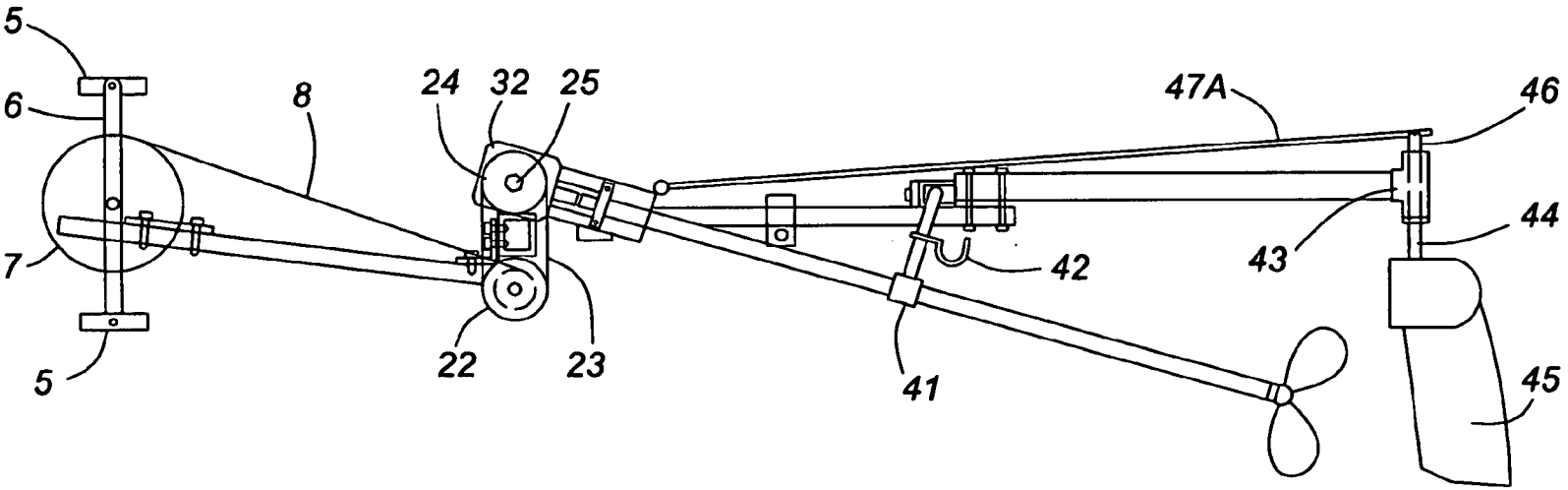
FIG. 4 is a side view, partly in section, of the embodiment of FIG. 1.
Figure 5:
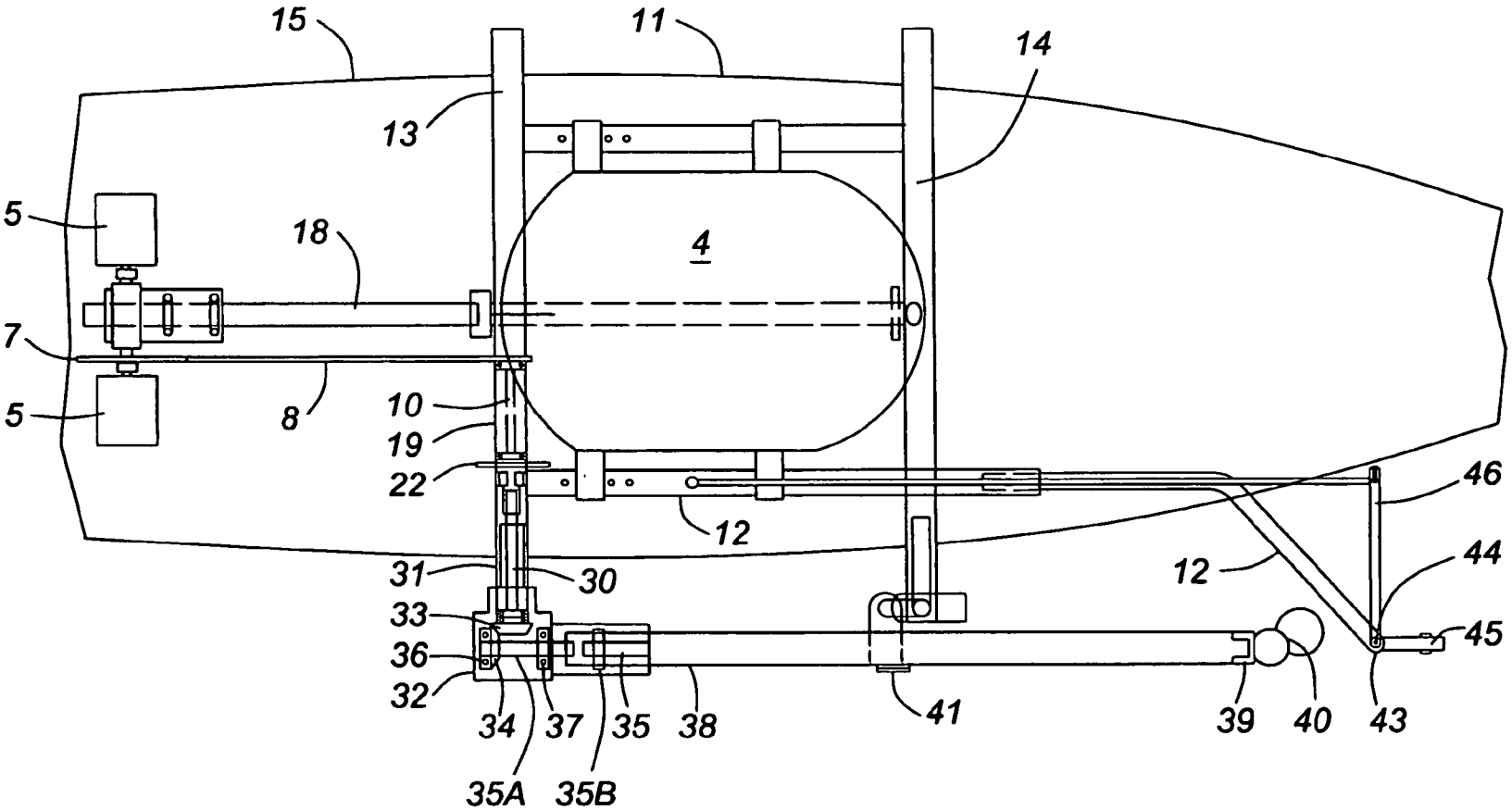
FIG. 5 is a plan view of the embodiment of FIG. 1.
Figure 6:
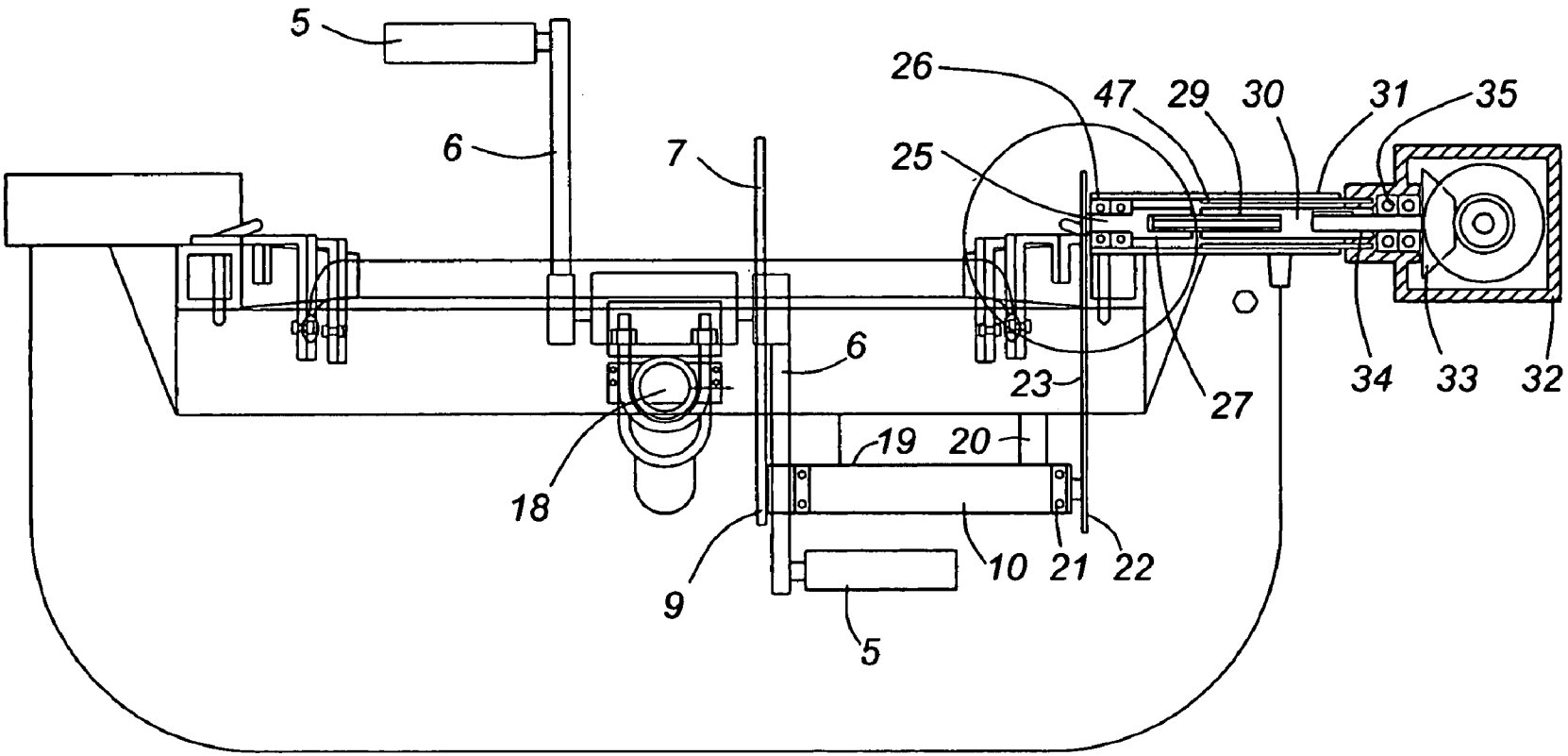
FIG. 6 is a front view of the embodiment of FIG. 1.
Figure 7:
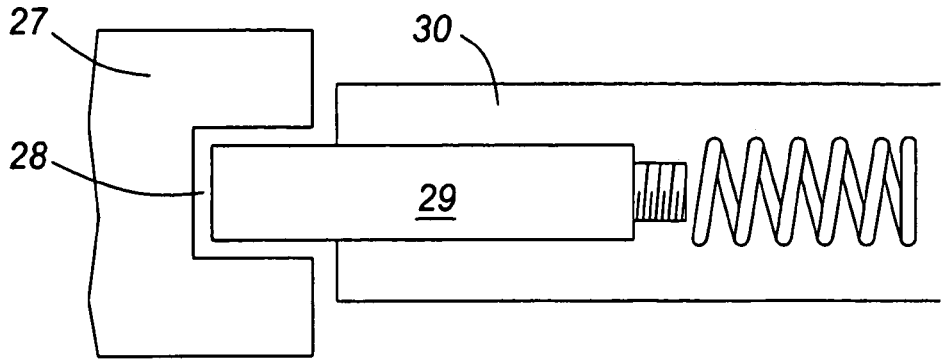
FIG. 7 is an enlarged detail view of the drive shaft shown in FIG. 6 in the engaged position.
Figure 8:
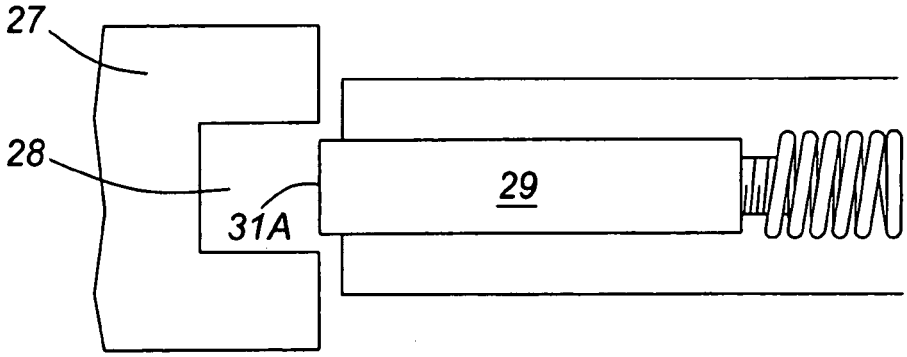
FIG. 8 is an enlarged detail view of the drive shaft shown in FIG. 6, in the disengaged position.
Figure 9:
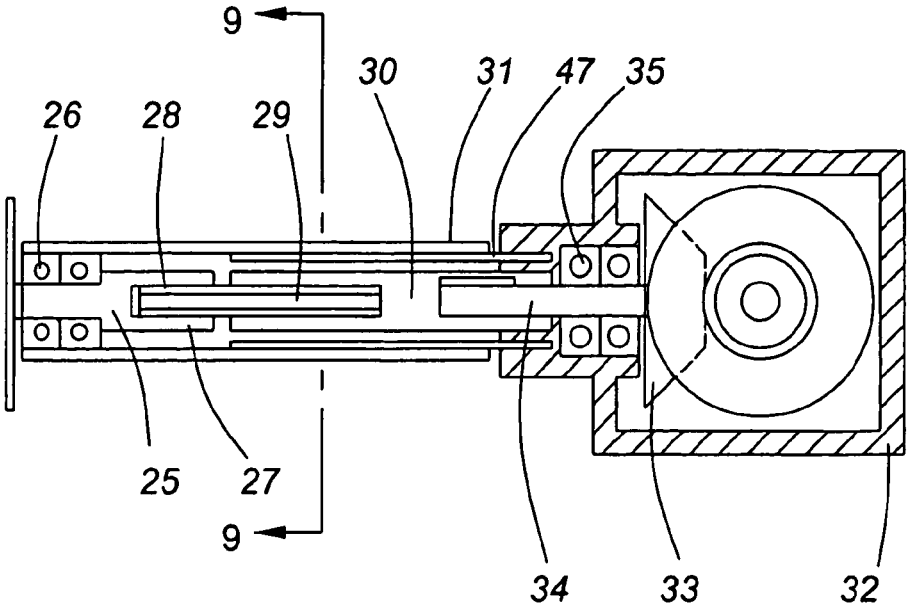
FIG. 9 is an enlarged view of part of FIG. 6.
Figure 11:
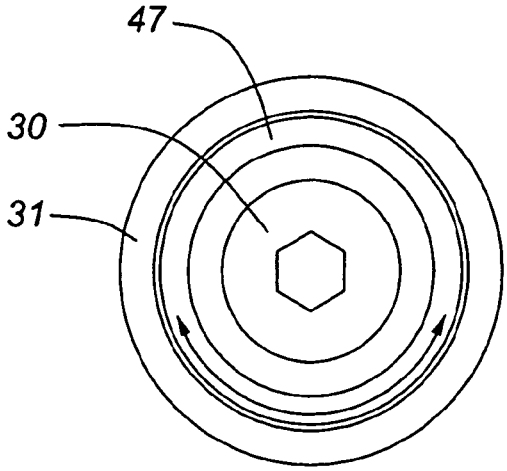
FIG. 11 is a sectional view of FIG. 9 taken along line 9—9.
Figure 10:
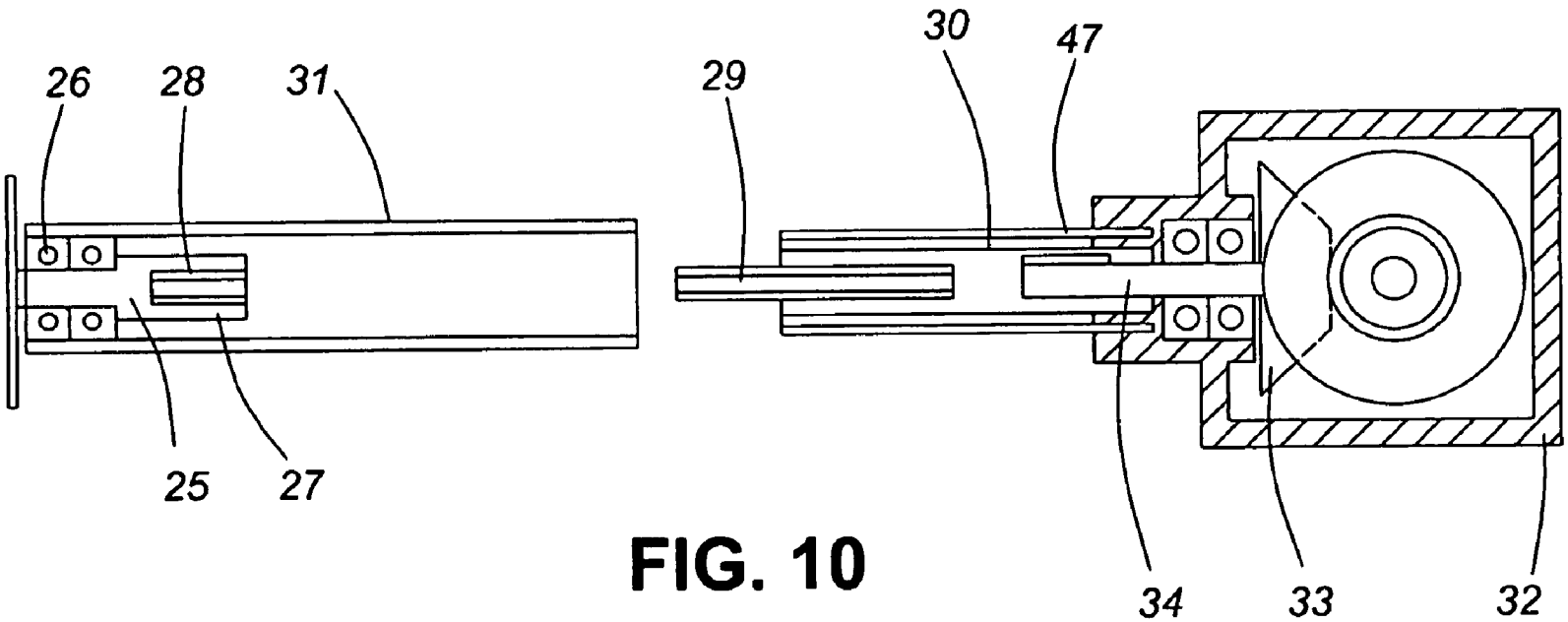
FIG. 10 is an exploded view of FIG. 9.

In FIG. 1 there is shown an isometric side view of one embodiment of the present invention with the drive shaft 2 in the angled, or lowered, position along the side of the canoe 1 upon which the device has been placed and rests on the gunwhales thereof. As seen most clearly in FIG. 5, a quadrilateral frame comprising a pair of parallel, longitudinally extending, tubular members 11,12 and a pair of parallel, transversely extending members 13,14, rests on the gunwhales 15,16 of canoe 1, immediately behind the central thwart 17 thereof and supports seat 4, preferably but not essentially adjustably, therebetween. It has been found that clamps, bolts or the like are not required to secure the frame to the canoe, but preferably the ends of transverse members are covered with a non-slip material, such as rubber, to provide additional grip and to reduce slippage. As seen in FIG. 1, a canoe operator 3, seated on seat 4 propels the canoe 1 by means of pedals 5 and cranks 6, mounted on a tubular member 18 forwardly of the quadrilateral frame on the longitudinal centre line and near the bottom of the canoe. Pedals 5 and cranks 6 are operatively mounted on toothed sprocket 7 which drives endless chain 8. Chain 8 is operatively connected to rear sprocket 9, mounted for rotation about a horizontal transverse axis on a lower transverse drive shaft 10, contained within drive tube 19 which is supported by a tubular member 20 depending from transverse tubular member 13. The outer end of shaft 10 is supported by bearing 21 and terminates in a sprocket 22 to drive endless chain 23 and sprocket 24. Sprocket 24 is mounted to one end of a transvers drive shaft 25 which in turn is rotatably mounted in bearing 26 on transverse member 13 at a level slightly above gunwhale 16. The outboard end of shaft 25 is provided with a hub 27 having a hexagonal axial bore 28 therein. A spring loaded hexagonal shaft 29 is slideably mounted in an axial bore of a drive shaft 30 so that an end 31A of shaft 29 can releasably engage in bore 28, as seen in FIG. 7. Shaft 30 is rotatably mounted within a tubular housing 31 and axially moveable so as to disengage shaft 29 when required and to align spring-loaded shaft 29 with bore 28 so as to engage therewith, one end of which supports bearing 26 and the other end of which rotatably supports gear box housing 32. A bevel gear 33, contained within housing 32, is splined to a shaft 34, rotatably supported by bearing 35, which is in turn axially splined to shaft 30. Bevel gear 33 operatively engages bevel gear 34, also contained within housing 32, axially mounted on an output drive shaft 35A which is supported by bearings 36,37 within housing 32 and connected to a propellor drive shaft 35 and supported by bearing 35Bcontained within a tubular casing 38. A cutlass bearing 39 is provided at the lower end of housing 38 to support shaft 35 adjacent a propeller 40. It will be appreciated that shaft 35 and tubular casing 38 can be moved in a vertical plane by rotating gear box housing 32 and tube 47 secured thereto and extending along a horizontal transverse axis inside housing 31, so that shaft 35 can be raised to a horizontal, inoperative, position parallel the gunwhale 16 in which propeller 40 is raised out of the water, and lowered to an angled, operative, position as seen in FIG. 4, in which the propeller 40 is below the water level. Preferably, housing 38 is supported, intermediate the ends thereof by either a hanger 41 adjustably suspended from transverse member 14 or a pair of hangers 41, 42 suspended from transverse member 14, so as to retain housing 38 in the operative position or the inoperative position as selected by the operator simply by reaching over the side of the canoe and without needing to turn or reach towards the stern of the canoe.

As seen in FIGS. 2,3, 4 and 5, longitudinal member 12 is somewhat longer than longitudinal member 11 and is angled outwardly towards the stern to support a rudder post housing 43, vertical rudder post 44 and rudder 45. A control arm 46 is mounted on rudder post 44, perpendicular to rudder 45, and pivotally mounted to a control rod or tiller 47A for operation by operator 3 to steer the canoe. Preferably but not essentially, rudder 45 is axially aligned with propeller 40.

It will be appreciated that many modifications may be made without departing from the spirit and scope of this invention as defined by the appended claims. For example, the conventional toothed sprockets 7,9,22 and 24 may, if desired be replaced with similarly conventional smooth pulley wheels with associated ribbed or plain rubber drive belts.

What is claimed is:

1. A portable, pedal driven propulsion device, for use in a watercraft having gunwhales, comprising:

(a) a substantially quadrilateral frame adapted to be releasably mounted on the gunwhales of said watercraft;

(b) operator seat means mounted on said quadrilateral frame;

(c) pedal crank means mounted forwardly of, and depending from, said quadrilateral frame and operable by an operator sitting on said seat means;

(d) a gear box pivotally mounted, on said quadrilateral frame so as to lie outboard of one of said gunwhales and forward of said operator seat means when in operative position;

(e) means to transmit motive power generated by said pedal crank means to said gear box, comprising first drive means operatively connected to a first end of a first transverse drive shaft, second drive means operatively connected to a second end of said first transverse drive shaft, a second transverse drive shaft means, including slideable means to selectively engage and disengage said second drive means and said gear box, operatively connected to said second drive means at a first end thereof and to said gear box at a second end thereof; and (f) longitudinal drive shaft means operatively connected at one end thereof to said gear box and, at a second end thereof, to a propeller means;

said gear box and longitudinal drive shaft means being adapted to be pivoted, when mounted on said watercraft, about a horizontal transverse axis so as to raise said propeller means to an inoperable position wherein said drive shaft means is substantially parallel to said one gunwhale, and lower said propeller means to an operative position wherein said drive shaft means is at an acute angle relative to said gunwhale.

2. A propulsion device as claimed in claim 1, wherein said drive shaft is rotatably mounted within a longitudinal tube means.

3. A propulsion device as claimed in claim 2, including means to support said tube means, intermediate the ends thereof, in a selected one of said operative and inoperative positions.

4. A propulsion device as claimed in claim 1 wherein said second transverse drive shaft means is rotatably mounted in transverse tube means mounted on said quadrilateral frame.

5. A propulsion device as claimed in claim 4 wherein said second transverse drive shaft means includes first bevel gear means at said second end thereof.

6. A propulsion device as claimed in claim 5 wherein said longitudinal drive shaft means includes second bevel gear means at said one end thereof.

7. A propulsion device as claimed in claim 6 wherein said first and second bevel gear means are contained within said gear box and mounted at right angles to each other for meshing engagement.

8. A propulsion device as claimed in claim 7 when mounted on said watercraft.

9. A propulsion device as claimed in claim 8 wherein said watercraft is a canoe.

10. A propulsion device as claimed in claim 1 wherein said operator seat means is adjustably mounted on said quadrilateral frame.

11. A propulsion device as claimed in claim 1 wherein said operator seat means is rigidly mounted on said quadrilateral frame.

12. A propulsion device as claimed in claim 1 wherein said first and second drive means comprise chain drive means.

* * * * *